United States Patent [19]

Buchwalder

[11] 4,381,045

[45] Apr. 26, 1983

[54] EXHAUST GAS SILENCER FOR A HEAT ENGINE

[75] Inventor: Jean-Pierre Buchwalder, Seloncourt, France

[73] Assignee: Cycles Peugeot, Valentigney, France

[21] Appl. No.: 343,121

[22] Filed: Jan. 27, 1982

[30] Foreign Application Priority Data

Feb. 2, 1981 [FR] France ..... 81 01940

[51] Int. Cl.[3] ..... F01N 1/08

[52] U.S. Cl. ..... 181/265; 181/272; 181/282

[58] Field of Search ..... 181/265, 268, 271, 272, 181/274, 279, 282

[56] References Cited

U.S. PATENT DOCUMENTS

| | | | |
|---|---|---|---|
| 1,514,441 | 11/1924 | Culp | 181/265 X |
| 3,682,270 | 8/1972 | Harew | 181/266 |
| 4,004,649 | 1/1977 | Shimada | 181/266 |

*Primary Examiner*—Benjamin R. Fuller

*Attorney, Agent, or Firm*—Sughrue, Mion, Zinn, Macpeak and Seas

[57] ABSTRACT

At least one of the ends of the silencer an end chamber is defined between an intermediate planar dished wall and an end dished wall which is provided with a rounded and hollow boss. The boss substantially extends two exhaust gas tubes in front of which it is located and its apex is spaced from the intermediate dished wall by a distance which is slightly greater than the radius of the tubes so that the boss guides the change in direction of the gas flow between the tubes.

5 Claims, 4 Drawing Figures

EXHAUST GAS SILENCER FOR A HEAT ENGINE

DESCRIPTION

Exhaust gas silencers for heat engines have for main function to reduce as far as possible the noise produced by the escape of the gases. However, they must avoid excessively hindering the flow of these gases since the power of the engine would be reduced, but on the other hand, they must have a volume which is as small as possible since the space available for the placement thereof is small, above all in respect of exhaust silencers of automobile vehicles.

This is why these silencers usually comprise a cylindrical case which is closed by end dished walls which are formed over onto the case and in which the tubes, which are supported by inner dished walls and communicate with each other in end chambers adjacent to the closing dished walls, guide the gases in a zig-zag path.

The cases of these silencers may have a circular, oval or other sectional shape, depending on the space available under, for example, the body, but, in any case, each end chamber connecting the successive tubes must have a relatively large volume in order to avoid hindering or retarding the flow of the gases so that the overall size of the silencer is still often a drawback.

An object of the present invention is to overcome this drawback by providing an exhaust gas silencer in which the volume of the end chamber is reduced, without this increasing the hindrance to the flow of the gases, this hindrance being even decreased.

The invention therefore provides an exhaust gas silencer for a heat engine comprising an outer cylindrical case and tubes for guiding the gases, interconnected by at least one end chamber defined within the case by a planar intermediate wall supporting the tubes and an end wall, wherein the end wall comprises, in the region of two successive tubes, a rounded and hollow boss which projects outwardly and whose apex is spaced from the intermediate wall by a distance which is slightly greater than the radius of the tubes, while the depth of the chamber around said boss is less than the diameter of said tubes so that the boss guides the change of direction of the flow of the gases between said tubes.

Owing to this guiding, the distance between the wall itself, ie. its planar portion, and the end of the tubes may be relatively small, which permits a reduction in the length of the cylindrical case and consequently in the overall size of the silencer.

The ensuing description of embodiments of the invention, which are given merely by way of examples and shown in the accompanying drawings, will more clearly bring out the advantages and features of the invention.

Figure 1:
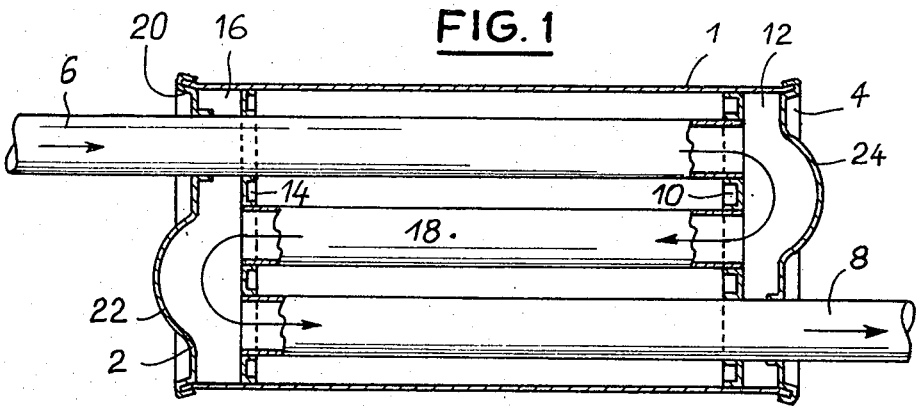
FIG. 1 is a diagrammatic longitudinal sectional view of a silencer according to the invention.

The illustrated silencer comprises a case 1, of cylindrical shape, closed at each end by a dished wall 2, 4 respectively. The wall 2 has extending therethrough an exhaust gas inlet tube 6 and the wall 4 has extending therethrough a tube 8 for the of these gases to the atmosphere.

Inside the case 1, the open end of the gas inlet tube 6 is fixed in an inner dished wall 10 which defines with the corresponding end wall 4 a chamber 12. Likewise, the open end of the outlet tube 8 is fixed in an inner dished wall 14 which defines with the corresponding end wall 2 a gas chamber 16. A third tube 18 interconnects the chambers 12 and 16 so that the gas entering by way of the tube 6 travels through a zig-zag path in which the gas changes direction twice before issuing by way of the tube 8.

The end wall 2 which supports the inlet tube 6 is formed by a planar element provided with an outwardly extending peripheral flange 20 which has sufficient length to be formed over and thereby fixed to the end edge portion of the case 1. Further, the wall 2 includes a rounded boss 22 which projects outwardly and has, as shown more clearly in FIG. 2, a substantially elliptical base. The major dimension of this base substantially corresponds to the sum of the two apertures formed in the wall 14 for fixing the tubes 18 and 8 and the wall portion which separates them, ie. to the distance between the two most remote generatrices of the tubes 18 and 8. The minor dimension of the boss 22 is slightly greater than the diameter of one of the tubes 18 or 8.

The boss 22 is preferably formed by a press operation which deforms the wall 2 outwardly so that this boss is progressively curved and forms a surface for guiding and deviating the flow of the gas between the tubes 18 and 8.

Figure 2:
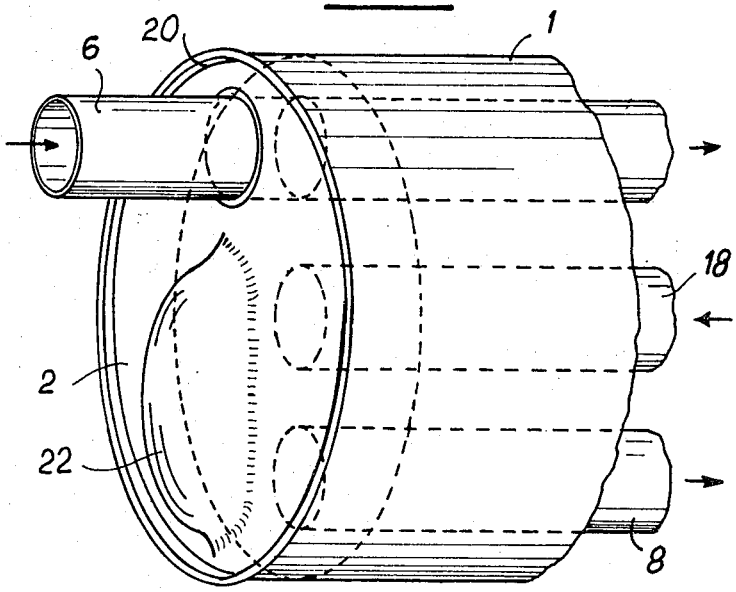
FIG. 2 is a perspective view, to an enlarged scale, of one of the end parts of the silencer of FIG. 1.

In the embodiment shown in FIGS. 1 and 2, the cylindrical case 1 has an oval base and the tubes 6, 18 and 8 are in alignment on the major axis of this oval. Consequently, the wall 2, which also has an oval shape, includes an aperture for the passage of the tube 6 which is located on the major dimension of the boss 22.

The wall 4 is constructed in the same way as the wall 2 and includes, as the latter, a rounded boss 24 which projects outwardly, and an aperture for the passage of the tube 8 located on the major dimension of the boss 24.

In each of these walls 2 or 4, the depth of the boss is relatively large and the projection of the apex outwardly of the planar portion substantially corresponds to the radius of the tube 18 or 8. On the other hand, this end wall is secured to the case 1 at a relatively small axial distance from the intermediate wall 10, 14, so that the chamber 12, 16 has, around the boss 22, an axial dimension which is at the most equal to the diameter of the tube 6, 16 or 8, while in the region of the apex of the boss, its dimension corresponds to that of a conventional end chamber.

In such a silencer, the exhaust gases entering the tubes 6 change direction, on one hand, in the chamber 12 between the ends of the tubes 6 and 18 and the wall of the boss 24, and, on the other hand, in the chamber 16 between the ends of the tubes 18 and 8 and the wall of the boss 22. The shape of the bosses 22 and 24 is such that these portions of the chambers 12 and 16 substantially form a continuation of the tubes 6 or 18 in which, owing to the absence of any guide wall between the tubes and the boss, the gases change direction without any brutal encounter of the latter with the wall and with a minimum of hindrance to the flow of the gases. Consequently, it is found that it is no longer necessary to give a large volume to the chambers 12 and 16 and that the walls 2 and 4 may be mounted much closer to the inner walls 10 and 14 than in conventional silencers. For example, the walls 2 and 4 may be brought closer together by a distance corresponding to the depth of the boss 22 or 24 and thus maintain sufficient volume for, in cooperation with the particular shape of the boss, avoiding a hindrance to the fluid by facilitating its flow.

Consequently, there is obtained a silencer which has a smaller overall size and yet ensures an efficient reduction of the noise. Moreover, the reduction in the overall size, i.e. in particular the reduction in the length of the case 1, results in a reduction in weight and consequently a cheaper silencer.

Figure 3:
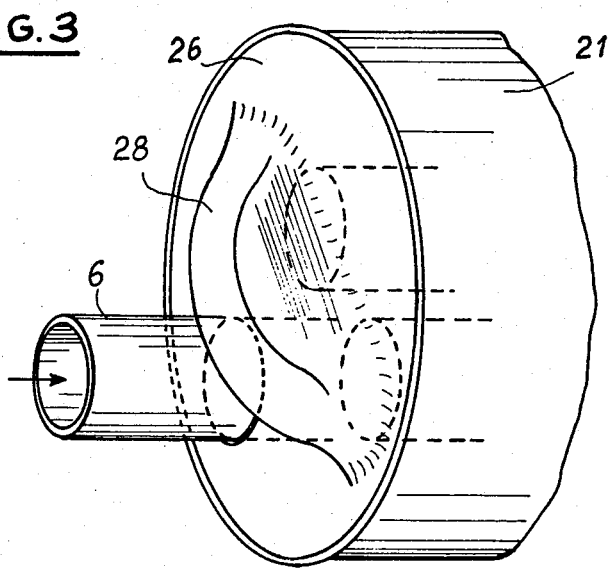
FIG. 3 is a view similar to FIG. 2 of another embodiment of the silencer.

It will be understood that the dished walls of the invention may be employed on silencers of various types, for example on silencers such as that shown in FIG. 3, whose outer case 21 is a cylinder having a circular base. In this case, the three tubes 6, 18 and 8 are no longer in alignment and each of the end dished walls 26 has a boss 28 whose shape is similar to that of the boss 22 or 24, and an aperture for the passage of the inlet tube 6 or outlet tube 8, formed on one side of this boss, and preferably centered on the extension of the median axis corresponding to the minor dimension of the boss.

Figure 4:
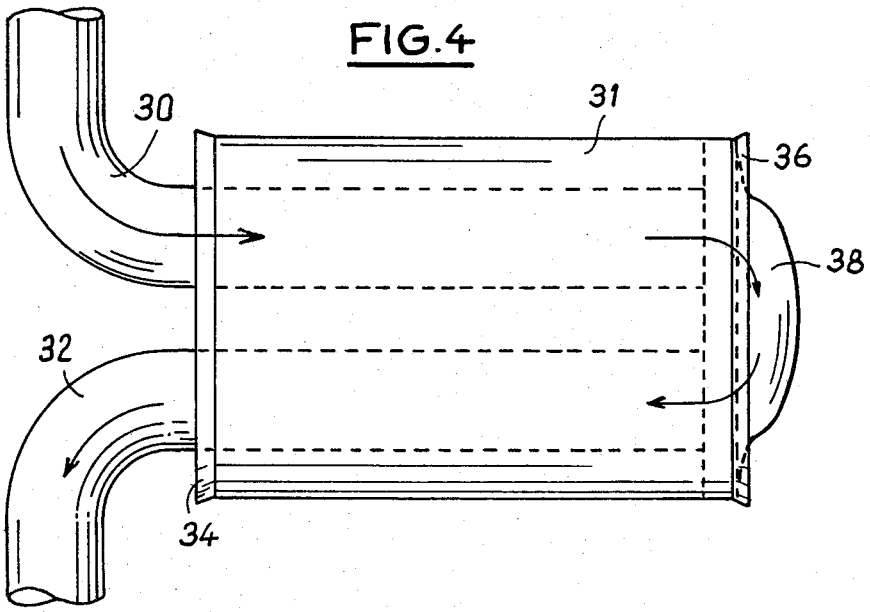
FIG. 4 is an elevational view of another modification of the silencer according to the invention.

Likewise, the invention encompasses silencers comprising a larger or smaller number of tubes. For example, FIG. 4 shows a silencer which has only two tubes, a gas inlet tube 30 and a gas outlet tube 32, which are secured in a common planar end dished wall 34. These two tubes extend through the length of the cylindrical case 31 and open onto a chamber which is closed by an end dished wall 36. The latter comprises a boss 38 for guiding and reversing the direction of the flow of the gas and projecting outwardly of the silencer and having a base which substantially correspond to the size of the two apertures for the tubes taken together. It will be understood that, if the silencer must have more than three tubes, at least one of the end dished walls may include a plurality of similar bosses, each one of which bosses ensures the guiding of the flow of the fluid between two successive tubes.

In any case, the silencer provided has an overall size which is less than that of a silencer of conventional type and, moreover, results in a much improved reduction in the noise. This type of silencer is consequently of particular use in the reduction of noise produced by the escape of the exhaust gases of automobile vehicles, in which the space available under the body is usually extremely small, but also in many other applications, owing in particular to its high efficiency and cheapness.

Having now described my invention what I claim as new and desire to secure by Letters Patent is:

1. An exhaust gas silencer for a heat engine, the silencer comprising an outer cylindrical case, a first end wall of the case, a second end wall of the case and a substantially planar intermediate wall of the case, and gas guiding tubes which are supported by said intermediate wall and are put into communication with each other by at least one end chamber which is defined within the case by said intermediate wall and said first end wall, said first end wall comprising in the region of two successive tubes of said tubes, a rounded and hollow boss which projects outwardly of the silencer and has an apex which is spaced from said intermediate wall by a distance which is slightly greater than the radius of the tubes, while the depth of the chamber around said boss is less than the diameter of said tubes so that the boss guides a change in direction of the gas flow between said successive tubes.

2. A silencer according to claim 1, wherein the boss has a base which has a minor dimension slightly greater than the diameter of one of the tubes and a major dimension which substantially equals the distance between the most remote generatrices of said two successive tubes.

3. A silencer according to claim 1 or 2, wherein said case has an oval cross-sectional shape and said first end wall has an oval shape corresponding to the oval cross-sectional shape of the outer case and comprises an aperture for the passage of a gas guiding tube which is located on a major axis of the base of the boss.

4. A silencer according to claim 1 or 2, wherein said case has a circular cross-sectional shape and said first end wall has a circular shape similar to said cross-sectional shape of the outer case and comprises an aperture for the passage of a gas guiding tube which is located on one side of the boss.

5. A silencer according to claim 1 or 2, comprising more than three of said gas guiding tubes, at least said first end wall including a plurality of said boss which are substantially similar to each other.

* * * * *